United States Patent [19]

Davis

[11] 4,116,352

[45] Sep. 26, 1978

[54] SEALING DEVICE

[75] Inventor: Charles S. Davis, Antioch, Calif.

[73] Assignee: Leonard Russo, San Rafael, Calif. ; a part interest

[21] Appl. No.: 737,762

[22] Filed: Nov. 1, 1976

[51] Int. Cl.[2] ..... B65D 53/00

[52] U.S. Cl. ..... 215/270; 215/274; 215/276; 200/240

[58] Field of Search ..... 215/260, 270, 271, 274, 215/341, 352, 276; 220/240

[56] References Cited

U.S. PATENT DOCUMENTS

| | | | |
|---|---|---|---|
| 532,499 | 1/1895 | Thatcher | 215/276 |
| 645,430 | 3/1900 | Smelker | 215/276 |
| 697,681 | 4/1902 | Smelker | 215/276 |
| 711,452 | 10/1902 | Meyer | 215/276 |
| 727,470 | 5/1903 | Smelker | 215/276 |
| 749,457 | 1/1904 | Smelker | 215/274 |
| 776,206 | 11/1904 | Smelker | 215/276 |
| 801,734 | 10/1905 | Lorenz | 215/270 |
| 802,001 | 10/1905 | Lorenz | 215/270 |
| 1,835,963 | 12/1931 | Nevius | 220/240 |
| 2,194,004 | 3/1940 | Bukolt | 215/271 |

FOREIGN PATENT DOCUMENTS

| | | | |
|---|---|---|---|
| 292,614 | 7/1929 | Great Britain | 220/240 |
| 1,151,366 | 5/1969 | Great Britain | 220/240 |

*Primary Examiner*—Ro E. Hart

*Attorney, Agent, or Firm*—Townsend and Townsend

[57] ABSTRACT

A pressure-type containment device with an improved lid sealing feature is disclosed. A lid disk seats on a shoulder along the interior wall of a container mouth and is held in place by a fastening ring adapted to fit into the container mouth. A resilient gasket, such as an O-ring, is wedged between the fastening ring and the lid disk along the interior wall of the mouth. The margin of the fastening ring confronting the gasket is tapered to urge the gasket against the interior wall. A pressure increase within the container expanding the lid disk causes compression of the gasket, enhancing the seal.

4 Claims, 4 Drawing Figures

SEALING DEVICE

BACKGROUND OF THE INVENTION

This invention relates to structures for sealing the openings of containers to prevent leakage of the contents and particularly to prevent the escape of contents maintained under pressure.

Cans and jars used in preserving fruit, vegetables and other food products, as well as pressure cookers, and other like containers must be able to maintain a pressure seal when closed. A variety of jar and pot sealing structures are known. A conventional seal for a jar, such as might be used in home preserves, comprises a disk for covering the jar mouth and a ring for cinching the disk against the jar mouth. A sealing gasket is provided which is generally disposed between the disk and the jar mouth so that the tightening of the ring assures a sealing contact. In this type of sealing structure, any increase in internal pressure tends to loosen the seal, increasing the probability of leakage.

A number of sealing structures have been proposed to overcome the problem of potential leakage resulting from increased internal pressure. Representative patents known to address the problem are U.S. Pat. No. 645,430 to Smelker, U.S. Pat. No. 711,452 to Meyer, British patent specification No. 485,051 to Fritsch, U.S. Pat. No. 2,967,944 to Davies, and U.S. Pat. No. 3,687,333 to Burnett et al. Although many of the prior art structures are designed to provide a tighter seal as internal pressure increases, many do not provide a satisfactory seal under certain conditions of negative and neutral pressure.

SUMMARY OF THE INVENTION

According to the present invention, an improved lid seal comprises a flexible lid disk which seats on an interior wall shoulder of a container mouth and which is held in place by a fastening ring adapted to fit into the container mouth. A resilient elastomeric gasket, such as an O-ring, is wedged between the fastening ring and the exterior side of the lid disk in confrontation with the interior wall of the mouth. The ring confronting margin of the fastening ring is tapered to urge the gasket into sealing relation with the interior wall and the exterior side of the lid disk. Any pressure elevation within the container tending to expand or outwardly flex the lid disk causes compression of the gasket and enhances the container seal.

DETAILED DESCRIPTION OF PREFERRED EMBODIMENTS

Figure 1:
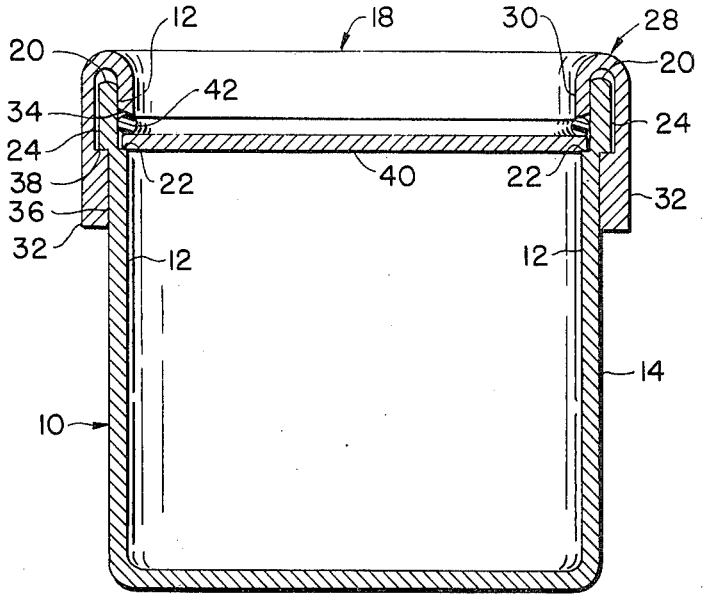
FIG. 1 is a side cross sectional view of a container illustrating the preferred embodiment of the present invention.
Figure 2:
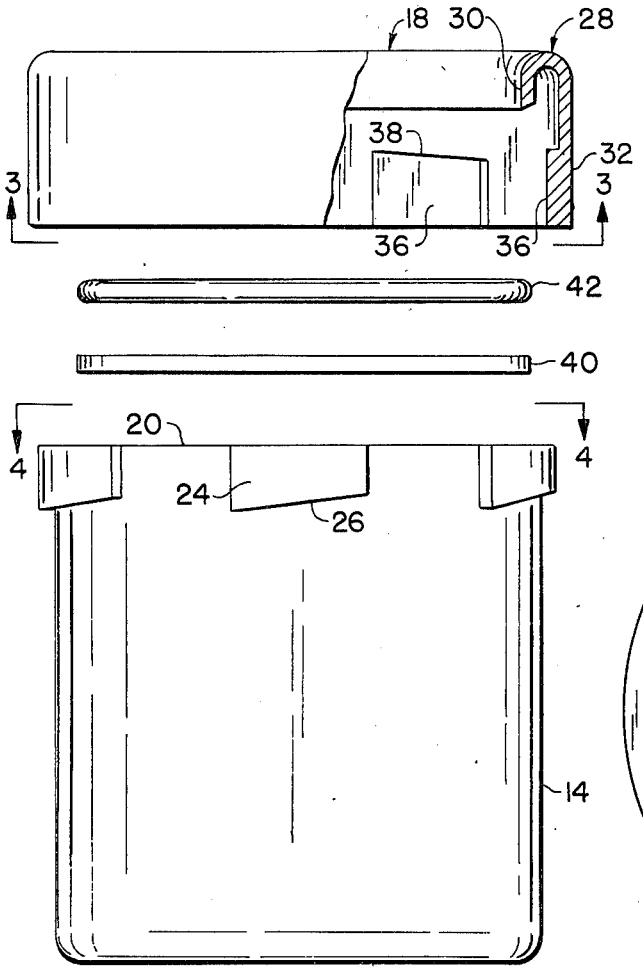
FIG. 2 is an exploded side view in partial cutaway illustrating the closure.
Figure 4:
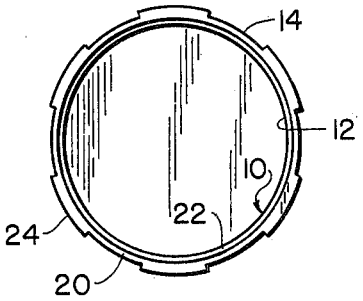
FIG. 4 is a top plan view of the container mouth.
Figure 3:
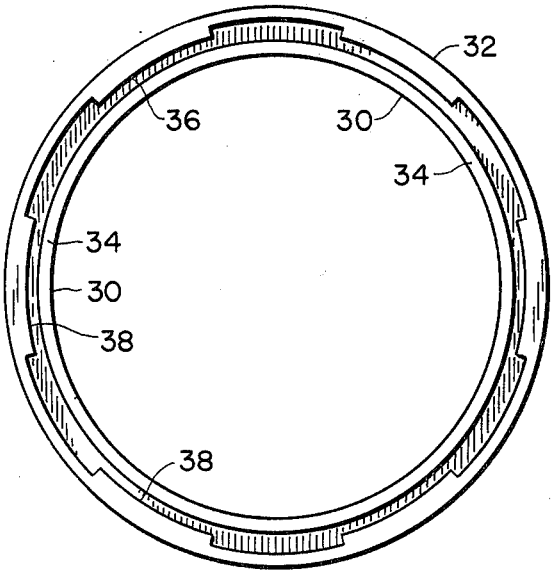
FIG. 3 is a bottom plan view of the sealing ring.

In FIG. 1 there is illustrated a vessel 10 adapted to employ a seal according to the invention. The container 10 comprises an interior wall 12, an exterior wall 14, a closed bottom end 16, an open mouth 18 opposite the bottom end 16, and a mouth rim 20. The inner wall 12 defines an annular shoulder or seal 22 disposed along the open mouth 18. The outer wall 14 defines at least one exterior flange 24 below rim 20. As seen most clearly in FIGS. 2 and 4, a plurality of flanges 24 may be provided, lower margins 26 of which define a partial spiral about rim 20 for interlocking with a mating covering.

In particular, an annular sealing ring 28 mates in bayonet fashion with mouth 18. The sealing ring 28 comprises an inner axial flange 30 and an outer axial flange 32 which are disposed to bridge rim 20. Outer flange 32 encompasses rim 20 and includes a plurality of radial projections 36. As shown most clearly in FIG. 2, projections 36 each include a shoulder 38 defining a partial spiral which complements lower margins 26. Inner axial flange 28 defines a continuous margin opposing shoulder 22. As shown most clearly in FIG. 1, inner flange 30 includes a beveled face 34 opposing seat 22 and slanted towards outer flange 32.

Closure of the mouth 18 is effected by a lid disk 40 which mates with seat 22. Disk 40 is an imperforate member capable of limited axial flexure. Disposed between disk 40 and and beveled face 34 is a sealing gasket or elastomeric O-ring 42 which is capable of at least partial expansion and deformation and which conforms generally to the inner wall 12 above seat 22.

In operation of the seal according to the invention, disk 40 is first placed on seat 22, followed by O-ring 42. The ring 28 is thereupon secured to the vessel 10 by the bayonet mount of flanges 24 and 36. As the ring 28 is tightened, face 34 is cinched against O-ring 42, urging O-ring 42 into tight sealing relation with inner wall 12 and the exterior margin of lid disk 40.

Since lid disk 40 is flexible, any increase in internal pressure, causing lid disk 40 to flex outwardly forces O-ring 42 into tighter engagement with inner wall 12 and also with the margin of disk 40 because the O-ring 42 deforms outwardly under the outwardly directed pressure of beveled face 34. Thus, the seal initially provided is tightened by any subsequent increase in internal pressure.

The invention can be embodied in a variety of containers including jars used in preserving or storing fruit, vegetables, or other food products, in pots, such as pressure cookers, or in tanks, such as might be used for spraying chemicals and the like. Furthermore, the seal is reusable so that the contents can be accessed and the vessel resealed without replacing any part except an occasional O-ring. Having thus described the invention, other embodiments incorporating the essential teachings hereof will be apparent in view of the present specification. It is therefore not intended that the invention be limited except as indicated by the appended claims.

I claim:

1. Sealing structure for a pressure-type containment vessel comprising:

a container;

a resilient lid disk;

a retaining ring; and an elastomeric O-ring;

said container comprising a mouth, an interior wall, an exterior wall, an annular shoulder disposed along said interior wall, and at least one flange along said exterior wall;

said lid disk being adapted to seat against said interior wall shoulder;

said retaining ring comprising a continuous annular ridge for opposing said interior shoulder and at least one ring flange adapted to engage said container flange;

said O-ring being deformable and sealably compressible between said lid disk, said confronting ridge and said interior wall for sealing said container upon engagement between said ring flange and said container flange;

said ring ridge being tapered to present an at least partially radially disposed margin for engaging said O-ring, whereby said O-ring is urged into tighter sealable contact with said interior wall and with said lid disk upon outward axial flexure of said lid disk.

2. Sealing structure according to claim 1, wherein said container flange and said ring flange define a bayonet coupling.

3. Sealing structure for a pressure-type containment vessel comprising:

a container having a mouth, an interior wall, an exterior wall, an annular rim between the interior wall and the exterior wall, and an annular shoulder along the interior wall;

a lid disk adapted to seat against the interior wall shoulder and thereby close off the mouth;

a retaining ring having a generally U-shaped cross section, the ring having an inner axial flange, an outer axial flange, and a bridge portion therebetween, the ring being adapted to overlie the container rim wherein the inner axial flange confronts the interior wall and extends toward the disk when the disk is seated on the shoulder, wherein the outer axial flange confronts the exterior wall, and wherein the bridge portion confronts the rim, the confrontation between the inner axial flange and the interior wall defining a generally snug fit, the inner axial flange having a tapered face remote from the bridge portion wherein the inner axial flange and the interior wall define a V-shaped annular groove which faces toward the disk;

an elastomeric O-ring adapted to overlie the periphery of the lid disk wherein the O-ring is seated in the V-groove when the retaining ring overlies the container rim;

first coupling means on the exterior wall of the container; and second coupling means on the outer axial flange;

the first and second coupling means being mutually engageable to urge the inner axial flange of the retaining ring toward the disk;

wherein the mutual engagement of the first and second coupling means compresses the O-ring within the volume defined by the V-groove and the lid disk;

whereby an outward pressure on the lid disk urges the O-ring more forcefully into the V-groove and more forcefully against the interior wall, thereby improving the seal.

4. Sealing structure for a pressure-type containment vessel comprising;

a container having a mouth, an interior wall, an exterior wall, an annular rim between the interior wall and the exterior wall, and an annular shoulder along the interior wall;

a flexible lid disk including a flexible margin adapted to seat against the interior wall shoulder and thereby close off the mouth;

a retaining ring having a generally U-shaped cross section, the ring having an inner axial flange, an outer axial flange, and a bridge portion therebetween, the ring being adapted to overlie the container rim wherein the inner axial flange confronts the interior wall and extends toward the disk when the disk is seated on the shoulder, wherein the outer axial flange confronts the exterior wall, and wherein the bridge portion confronts the rim, the inner axial flange having a tapered face remote from the bridge portion wherein the inner axial flange and the interior wall define a V-shaped annular groove which faces toward the disk;

an elastomeric O-ring adapted to overlie the periphery of the lid disk wherein the O-ring is seated in the V-groove when the retaining ring overlies the container rim;

a first bayonet flange on the exterior wall of the container; and a second bayonet flange on the outer axial flange of the retaining ring;

the first and second bayonet flanges being mutually engageable to define a bayonet coupling between the container and the retaining ring, wherein engagement urges the retaining ring toward the disk;

wherein the mutual engagement of the first and second bayonet flanges compresses the O-ring within the volume defined by the V-groove and the lid disk;

whereby an outward pressure on the lid disk urges the O-ring more forcefully into the V-groove and more forcefully against the interior wall, thereby improving the seal; and whereby axial flexure of the lid disk is transmitted to the lid disk margin, and urges the O-ring outwardly against the interior wall.

* * * * *